US006627013B2

(12) United States Patent
Carter, Jr. et al.

(10) Patent No.: US 6,627,013 B2
(45) Date of Patent: Sep. 30, 2003

(54) PYROTECHNIC THERMITE COMPOSITION

(76) Inventors: Greg Carter, Jr., P.O. Box 3355, Joplin, MO (US) 64803; Greg Carter, Sr., P.O. Box 3355, Joplin, MO (US) 64803

( * ) Notice: Subject to any disclaimer, the term of this patent is extended or adjusted under 35 U.S.C. 154(b) by 0 days.

(21) Appl. No.: 10/062,500

(22) Filed: Feb. 5, 2002

(65) Prior Publication Data

US 2003/0145924 A1 Aug. 7, 2003

(51) Int. Cl.[7] ..... C06B 33/00; C06B 33/12
(52) U.S. Cl. ..... 149/37; 149/40
(58) Field of Search ..... 149/19.1, 37, 40

(56) References Cited

U.S. PATENT DOCUMENTS

| | | | | |
|---|---|---|---|---|
| 362,905 A | | 5/1887 | Sibley | |
| 1,154,165 A | | 9/1915 | Beckwith | |
| 2,399,211 A | | 4/1946 | Davis et al. | |
| 3,713,636 A | | 1/1973 | Helms et al. | |
| 3,745,077 A | * | 7/1973 | Jones | 149/40 |
| 4,104,093 A | | 8/1978 | Yamaji | |
| 4,141,769 A | | 2/1979 | Akiyama | |
| 4,349,396 A | | 9/1982 | Mueller et al. | |
| 4,371,771 A | | 2/1983 | Faccini et al. | |
| 4,432,816 A | | 2/1984 | Kennedy et al. | |
| 4,963,203 A | | 10/1990 | Halcomb | |
| 4,996,922 A | | 3/1991 | Halcomb et al. | |
| 5,429,691 A | * | 7/1995 | Hinshaw et al. | 149/45 |
| 5,525,163 A | | 6/1996 | Conaway et al. | |
| 5,650,590 A | | 7/1997 | Taylor | |
| 5,936,184 A | * | 8/1999 | Majerus et al. | 89/1.13 |
| 6,183,569 B1 | | 2/2001 | Mohler | |
| 6,308,607 B1 | | 10/2001 | Woodall et al. | |

* cited by examiner

*Primary Examiner*—Michael J. Carone
*Assistant Examiner*—Aileen B. Felton
(74) *Attorney, Agent, or Firm*—Walter M. Benjamin

(57) ABSTRACT

A thermite composition for pyrotechnics having high heat transfer charactistics comprising a strongly reducible metal oxide, a thermally decomposable heat transfer agent consisting of $Cu_2O$, and a strong reducing agent. It is desirable that the stoichiometerics and mechanics of the thermite reaction is such that there is a substantial excess of oxygen. Also, other ingredients may be added to the composition such as gas generating compounds, binders, diluents and supplemental oxidizing agents.

13 Claims, No Drawings

PYROTECHNIC THERMITE COMPOSITION

BACKGROUND OF THE INVENTION

1. Field of the Invention

This invention relates to a thermite composition, more particularly, this invention relates to a thermite composition for pyrotechnics, and even more particularly, this invention relates to a relatively slow burning thermite composition for pyrotechnics that has an extremely high rate of heat transfer for purposes such as demilitarizing ordnance, military weapons, fuel, metal cutting, welding, brazing and operations on metal work pieces.

2. Description of the Prior Art

Thermite compositions are very well known and consist generally of a mixture of a finely divided, strongly reducible metal oxide, typically consisting of ferrous oxide, and a finely divided strong reducing agent, typically consisting of aluminum. Once ignited, the composition reacts highly exothermically as the strong reducing agent has negative free energy, typically above 90,000 calories per gram atom of oxygen at a reference of 25° C. and the strongly reducible metal oxide has a negative free energy as high as about 60,000 calories per gram atom of oxygen at a reference of 25° C. Consequently, 750 kilocalories is released thereby raising the temperature of the products to about 3000° C. under favorable conditions as it produces little or no permanent gas and yields aluminum oxide and molten iron. The heat from the molten iron and aluminum oxide is used for various purposes, such as destruction of military targets and munitions, incendiary weapons, cutting and welding torches, igniter for other reactions such as activation of air bags, plating of metals upon substrates, cutting or plugging oil well conduits, and the like.

Other types of thermite compositions containing metals and the oxides of other metals other than iron oxide are known. The metal oxides include FeO, $Fe_2O_3$, CoO, NiO, $Cu_2O$, CuO, $Sb_2O_3$, $MoO_2$, $MoO_3$, $Cr_2O_3$, $PbO_2$, $WO_2$, $WO_3$ and others. The Oxidizable metals include Al, Si, Zr, Be, Mg, Ba, Ti, B and others.

For many of these applications, it is desirable to maximize the transfer of heat from the thermite reaction to a target or substrate or workpiece. To some of these thermite compositions were added gas producing compounds such as carbides to produce high pressure and high velocity gases such as is taught by Halcomb, et. al. in U.S. Pat. No. 4,963,203. This composition, in its preferred embodiment consist of 79.5% CuO and 17.5% Al and 3% SiC, was designed to be thermally stable to a temperature of about 500° C. While this composition may be suitable for some applications, it is not designed to optimize heat transfer when the products of the reaction contact a target or workpiece, rather it is designed for high pressure and high velocity. In another application, into a flame spray, a thermit composition is introduced containing a reducible metal oxide and a strong oxidizing agent thereby enabling the production of a one-step coating of substantial thickness.

In U.S. Pat. No. 4,202,691 issued to Yurasko, Jr. an example of an agglomerate of 50% by weight each of NiO and Al in a binder of sodium silicate was mixed and dried. This agglomerate was mixed with nickel powder and sprayed upon a steel substrate using an oxyacetylene torch. The steel substrate was thereby coated using this process. Atomizing the metal and depositing them upon a substrate is excellent for coating metals but is not designed to maximize the transfer of the heat of the reaction to the substrate.

U.S. Pat. No. 4,349,396 discloses a metal-cutting pyrotechnic composition. This composition utilizes a oxidizer selected from the group consisting of calcium sulfate hemihydrate, anhydrous calcium sulfate, magnesium monohydrate, anhydrous magnesium sulfate, anhydrous strontium sulofate, and mixtures thereof, a metal fuel, a halopolymeric binder; and sulfur. In this application an appreciable amount of heat per unit volume of composition is produced without generating an appreciable amount of gas. The patent teaches that gas generation, as an incident of oxygen reactions absorbs the heat of the reaction and removes it from the reaction system. The patent further teaches that the oxidizer reacts primarily with the metal fuel, secondarily with any carbon of hydrogen present in the composition, and with the workpiece, and consequently the best composition has an excess of oxidizer up to about 80% by weight. While this composition is effective in that it uses by conduction the heat of the reaction and supply an excess of oxygen for the workpiece after it is heated wherein the oxygen comes from the oxidizers selected. Again, this composition does not take advantage of optimum heat transfer.

SUMMARY OF THE INVENTION

These disadvantages are overcome as well as novel advantages are realized in the present invention. Applicant has found that the latent heat of vaporization and the latent heat of crystallization can be utilized from the reaction products of a thermite composition thereby transferring immediately a tremendous amount of heat instantly to a target, substrate or workpiece. It has been found the if gaseous products of a thermite reaction impinge upon a target, substrate or workpiece and fuse and crystallize upon impact, a tremendous amount of latent heat is transferred instantly. Thereby a target can be instantly demolished, a substrate can be worked upon immediately at high temperature or a workpiece can be cut or brazed or welded in an instant.

These advantages are realized by a thermite composition for pyrotechnics which comprises a strongly reducible metal oxide, a decomposable heat transfer agent consisting of $Cu_2O$, and a strong reducing agent. It is desirable that the stoichiometerics and mechanics of the ignited composition is such that a substantial excess of oxygen is available. It is preferred that the strong oxidizing agent comprise CuO and the thermally decomposable heat transfer agent is $Cu_2O$ because copper is vaporizable at the reaction temperatures and has high thermal conductivity. Also other ingredients may be added to the composition such as gas generating compounds, binders, diluents and supplemental oxidizing agents. Certain of these compositions can be environmentally safe, can be made from readily available and relatively inexpensive materials, can be burned with simple equipment, does not produce a light harmful to the eyes and does not produce a significant amount of smoke or harmful fumes.

DETAILED DESCRIPTION OF THE INVENTION

The thermite composition for pyrotechnics of the present invention includes a strongly reducible metal oxide, a thermally decomposable heat transfer agent consisting of $Cu_2O$, and a strong reducing agent where metals released in the reaction are substantially vaporizable and have high thermal conductivity. Also, other ingredients may be added to the composition such as gas generating compounds, binders, diluents and supplemental oxidizing agents.

The strongly reducible metal oxide is taken from the group consisting of FeO, $Fe_2O_3$, CoO, NiO, $Cu_2O$, CuO, $Sb_2O_3$, $MoO_2$, $MoO_3$, $Cr_2O_3$, $PbO_2$, $WO_2$, and $WO_3$ or a combination thereof and is provided in the range of about 35–55% by weight. It is preferred that the strongly reducible metal oxide of the present invention is more reactive than the thermally decomposable heat transfer agent. Accordingly, the strongly reducible metal oxide is preferably taken from the group consisting of $Fe_2O_3$, NiO, CuO, and CoO. It is even more preferred that the strongly reducible metal oxide is CuO. The thermally decomposable heat transfer agent is $Cu_2O$ and is provided in an amount of about 20–55% by weight. The strong reducing agent is taken from the group consisting of Al, Si, Zr, Be, Mg, Ba, Ti, and B and is provided in an amount of about 5–20% by weight. It is preferred that the strong reducing agent is taken from the group consisting of Al, Mg, Si and Be.

Other ingredients that may be added are gas generating compounds taken from the group consisting of metal carbides and metal nitrides and nitrates provided in the range of about 0–5% by weight. Diluents may be added taken from the group consisting of LiF, $NiF_3$, $FeCl_3$, $AlF_3$, $NiF_2$, $CaF_2$, $CrF_2$, $CrCl_3$, CaO, $Na_2SO_4$, $SiO_2$, KCl, $TiO_2$, $CrF_3$, $MgCl_2$, $CaCl_2$, $NiF_3$, $FeCl_3$, $MgF_2$, MnO, $Fe_2O_3$, $B_2O_3$, $Mg_0$ and $Al_2O_3$ or a combination thereof. The diluent is added in an amount to decrease the rate of the reaction for a particular desired purpose. Typically, the diluent will be provided in small amounts in the range of 0–2% by weight. It is preferred that the diluent is provided in the range of about 0–1.5% by weight. These diluents are chosen to further enhance the reaction of the invention. It should be understood that gas generating agents and supplemental oxidizing agents can also act as diluents.

Supplemental strong oxidizing agents are well known and are taken from the group consisting of metal oxides, chlorates, perchlorates, peroxides, nitrites and nitrates or a combination thereof. These supplemental oxidizing agents may be added from 0–20% by weight. The preferred supplemental strong oxidizing agent is $NaClO_3$. The supplemental oxidizing agent can also act as a diluent.

The binder is a thermally fugitive agent which is decomposable or vaporizable during drying or during the reaction. The binder is provided in the range of about 0–2% by weight. These binders are well known in the art. A preferred binder would is polyethylene glycol.

It is preferred that all of the components is provided in an average grain size under 10 microns. It is further preferred that the strong reducing agent is provided in an average grain size smaller than the other components. In a preferred embodiment of the invention, the composition is made by mixing the ingredients by means well known in the art. The mixture is then dried and degassed to minimize moisture and gas therefrom and then formed into a means in which the mixture will be ignited.

Ignition means may be by electric arc, heated wire, laser, electromagnetic radiation, chemical reaction, blasting cap, detonator and the like. Upon ignition, the strongly reducible metal oxide reacts primarily to produce the exothermic thermite reaction. While some of the heat transfer component, $Cu_2O$, reacts in the thermite reaction, it is primarily heated and decomposes at about 1800° C. by the reaction products of the redox reaction. Thereby copper metal substantially in the gaseous state and oxygen is released in the form of a flame propagating from the burning mixture. When CuO is the strongly reducible metal oxide, copper in the gaseous state further results from the CuO thermite reaction. This gaseous copper is also propagated with the flame. The resultant gaseous copper and oxygen is available to heat an objective and supply oxygen for oxidation. When the products of the reaction is impinged upon an object, intense heat is transferred instantly from the gaseous copper in terms of latent heat of fusion, latent heat of crystallization and thermal conductivity. The oxygen from the reaction is available for the object to be oxidized.

It is well known in the art that by adjusting parameters such as blend ratios, density, particle size and forming techniques, the composition of the present invention may be modified in terms of burn rate and heat transfer intensity. For example, the exothermic reaction proceeds at a slower rate as composition density is increased. Heat transfer rate is slower where lesser thermally conductive compounds are used. While the invention is intended primarily for a relatively slow burn rate, it is envisioned that the invention may be used in explosive applications. This invention has been described with regard to specific embodiments and preferred combinations, however it is understood that modifications and adjustments and uses of the invention may be made without departing from the inventive intent herein. These modifications or adjustments or varying uses made by combining the invention with known and customary practices in the art falls within the scope of this invention and the claims herein.

What is claimed is:

1. A thermite composition for pyrotechnics having high heat transfer charactistics comprising:

(a) a strongly reducible metal oxide;

(b) a strong reducing agent; and (c) a thermally decomposable heat transfer agent consisting of $Cu_2O$.

2. The thermite composition of claim 1, wherein:

(a) the strongly reducible metal oxide is taken from the group consisting of FeO, $Fe_2O_3$, CoO, NiO, $Cu_2O$, CuO, $Sb_2O_3$, $MoO_2$, $MoO_3$, $Cr_2O_3$, $PbO_2$, $WO_2$, and $WO_3$; and (b) the strong reducing agent is taken from the group consisting of Al, Si, Zr, Be, Mg, Ba, Ti, and B.

3. The thermite composition of claim 1, wherein the strongly reducible metal oxide is taken from the group consisting of $Fe_2O_3$, NiO, CuO, and CoO and the strong reducing agent is taken from the group consisting of Al, Si, Mg, and B.

4. The thermite composition of claim 1, wherein the composition further contains:

(a) a supplemental strong oxidizing agent taken from the group consisting of metal oxides, chlorates, perchlorates, peroxides, nitrites and nitrates or a combination thereof; and (b) a binder.

5. The thermite composition of claim 1, wherein the strongly reducible metal oxide is CuO, the strong reducing agent is Al, and the supplemental strong oxidizing agent is $NaClO_3$.

6. The thermite composition of claim 1, wherein the strongly reducible metal oxide is $Fe_2O_3$, the strong reducing agent is Al, and the supplemental strong oxidizing agent is $NaClO_3$.

7. The thermite composition of claim 1, wherein the strongly reducible metal oxide is CuO, the strong reducing agent is Al and the supplemental strong oxidizing agent is a nitrate.

8. The thermite composition of claim 1, wherein the strongly reducible metal oxide is $Fe_2O_3$, the strong reducing agent is Al, and the supplemental strong oxidizing agent is a nitrate.

9. The thermite composition of claims 5, wherein the composition further contains a binder.

10. The thermite composition of claim 1, wherein the strongly reducible metal oxide is CuO provided in the range of about 35–55% by weight, the supplemental strong oxidation agent is NaClO3 provided in the range of about 0–12% by weight, and the binder is polyethylene glycol provided in the range of 0–1.5% by weight.

11. The thermite composition of claim 1, which further contains a supplemental strong oxidizing agent, a binder and a diluent taken from the group consisting of LiF, $NiF_3$, $FeCl_3$, $AlF_3$, $NiF_2$, $CaF_2$, $CrF_2$, $CrCl_3$, CaO, $Na_2SO_4$, $SiO_2$, KCl, $TiO_2$, $CrF_3$, $MgCl_2$, $CaCl_2$, $NiF_3$, $FeCl_3$, $MgF_2$, MnO, $Fe_2O_3$, $B_2O_3$, MgO, and $Al_2O_3$ or a combination thereof.

12. A thermite composition for pyrotechnics having a high heat transfer, comprising:

(a) a strongly reducible metal oxide taken from the group consisting of FeO, Fe.sub2 O3, CoO, NiO, Cu.sub2 O, CuO, Sb2 3O, MoO2, MoO3, Cr2 O3, PbO2, WO2, and WO3;

(b) a strong reducing agent taken from the group consisting of Al, Si, Zr, Be, Mg, Ba, Ti, and B;

(c) a strong supplemental oxidation agent taken from the group consisting of metal oxides, chlorates, perchlorates, peroxides, nitrites and nitrates or a combination thereof; and (d) a binder.

13. A thermite composition of claim 12, which further comprise a gas generating compound taken from the group consisting of carbides, nitrides and nitrates.

* * * * *